United States Patent [19]

Williger

[11] Patent Number: 4,961,235

[45] Date of Patent: Oct. 9, 1990

[54] SOCK WITH POCKET AND RELATED METHOD

[76] Inventor: Karen S. Williger, 716 Michelle Court, Gretna, La. 70056

[21] Appl. No.: 344,314

[22] Filed: Apr. 27, 1989

[51] Int. Cl.[5] ..... A41B 11/00

[52] U.S. Cl. ..... 2/239; 2/61; 2/243 R; 2/247; 2/252; 66/178 R

[58] Field of Search ..... 2/247, 239, 252, 61, 2/160, 162, 239, 247, 409; 66/169, 170, 171, 172, 173, 178 R

[56] References Cited

U.S. PATENT DOCUMENTS

| | | | |
|---|---|---|---|
| 767,381 | 8/1904 | Brown | 2/239 |
| 1,117,591 | 11/1914 | Morningstein | 2/239 |
| 2,039,197 | 4/1936 | Strieby | 2/239 |
| 2,282,545 | 5/1942 | Rosenstein | 2/247 |
| 2,432,378 | 12/1947 | Burton | 2/247 |
| 2,492,862 | 12/1949 | Harvey | 2/247 X |
| 2,496,734 | 2/1950 | Macreadie | 2/160 |
| 2,671,903 | 3/1954 | Breul | 2/247 |
| 2,691,779 | 10/1954 | Bell | 2/239 |
| 2,814,807 | 10/1957 | Dollar | 2/239 |
| 2,890,461 | 6/1959 | Hartman et al. | 2/239 |
| 3,085,254 | 4/1963 | Culter | 2/247 |
| 4,005,494 | 2/1977 | Burn | 2/239 |
| 4,038,699 | 8/1977 | Burn | 2/239 |
| 4,040,275 | 8/1977 | Castello | 66/196 |
| 4,139,914 | 2/1979 | Tarr | 2/247 |
| 4,166,463 | 9/1979 | Bloom | 2/239 |
| 4,428,080 | 1/1984 | Takamatsu | 2/227 |
| 4,445,233 | 5/1984 | Rubin | 2/239 |
| 4,498,200 | 2/1985 | Livingstone | 2/247 |
| 4,625,340 | 12/1986 | Hernandez | 2/247 |

FOREIGN PATENT DOCUMENTS

| | | | |
|---|---|---|---|
| 2743741 | 4/1978 | Fed. Rep. of Germany | 2/239 |
| 2213743 | 8/1974 | France | 2/239 |
| 2363292 | 3/1978 | France | 2/239 |

*Primary Examiner*—Werner H. Schroeder
*Assistant Examiner*—Jeanette E. Chapman
*Attorney, Agent, or Firm*—C. Emmett Pugh

[57] ABSTRACT

A sock with a pocket in which the fabric of the sock itself is used as the primary material used in the construction of the sock compartment. The present invention contemplates a variety of embodiments, including both horizontal and vertical opening members for the pocket(s), as well as teaching a variety of means of closure, including zippers (FIG. 4), "Velcro" (TM) (FIG. 5), buttons (FIG. 6), strings or ribbons (FIG. 7), and the like, or no closure (FIG. 8). The method of the present invention may be used with "off-the-shelf" socks and the like, and comprises essentially the folding over of the cuff of the sock, "sealing" the fold by sewing the folded portion to create a compartment, and providing resealable closure means to enter said compartment via the use of the "Velcro" (TM), buttons, zippers, snaps or the like, with a slit (which can be reinforced) being made through the material at the closure means to provide access into the compartment. Alternatively, the pocket is fabricated during the knitting or looming process of the sock itself, resulting in further labor and time savings.

30 Claims, 3 Drawing Sheets

SOCK WITH POCKET AND RELATED METHOD

BACKGROUND of INVENTION

1. Field of Invention

The present invention relates to socks and hosiery, and in particular to a new and unique method of fabricating pockets in socks and the like which is more efficient and cost effective than prior art methods.

The present invention teaches a sock with a pocket and related method, which utilizes less steps in manufacture than that taught in the prior art and can be implemented in fabricating pockets with "off the shelf" socks with relatively little difficulty. Further, the present invention contemplates the utilization of the fabric of the sock itself as the primary material used in the construction of the sock compartment.

The present invention contemplates a variety of embodiments, including both horizontal and vertical opening members for the pocket(s), as well as teaching a variety of means of closure, including Velcro (TM), zippers, buttons, strings, and the like.

2. Prior Art & General Background

The present invention teaches a wholly new and unique method and apparatus for the fabrication and utilization of pockets in hosiery such as children's socks, athletic socks, and the like. Unlike the prior art, the present invention contemplates a pocket which is fabricated from the sock itself and not as a separate pouch.

A list of prior patents which may be of interest are cited as follows:

| U.S. Pat. No. | Patentee(s) | Issue Date |
|---|---|---|
| 2,039,197 | Strieby | 04/28/36 |
| 2,691,779 | Bell | 10/19/54 |
| 2,814,807 | Dollar | 10/03/57 |
| 2,890,461 | Hartman et al | 06/06/59 |
| 4,005,494 | Burn | 02/01/77 |
| 4,038,699 | Burn | 08/02/77 |
| 4,428,080 | Takamatsu | 01/31/84 |
| 4,445,233 | Rubin | 05/01/84 |
| 4,498,200 | Livingstone | 02/12/85 |

As may be seen by a review of the above patents, the prior art teachings regarding pockets in socks and the like all rely upon a separate pouch member, with the member forming the pocket, or a separate fabric swatch applied to the sock, with the swatch forming one wall of the pocket.

For example, see the Burn and Hartman patents, which disclose various pockets in socks incorporating a separate pouch member into an "off-the-shelf" sock configuration.

For an example of the utilization of a separate fabric swatch applied to the sock as a means of forming a wall of the pocket, note the Dollar and Rubin patents.

The prior art methods of forming pockets in socks required the utilization of fabric separate from the "off-the-shelf" sock, and required extra steps in the fabrication of the pockets therein.

With the first prior art method as disclosed in Burn and Hartman, a separate pouch member at first had to be fabricated. This pouch member then had to be applied to the sock. Further, an opening and closure member had to be formed in the sock, thereby requiring excess fabric and labor.

Additionally, it is noted that the embodiments as disclosed in the Burn patents have an inherent problem which renders the pocket's use inconvenient. As the pouch member is separate from the sock (FIG. 3 of the '699 and '494 patents), the pouch must be situated relative to the user's leg before use can occur. Further, the pouch member appears that it would tend to "bunch" against the user's leg, causing discomfort. Still further, the utilization of the pocket for all but the lightest materials will cause discomfort and will tend to pull the sock down the user's leg.

This makes the Burn and Hartmann embodiments particularly unsuitable for carrying keys and the like in the pocket during athletic endeavors.

3. General, Summary Discussion of the Invention

The present invention contemplates an improvement over prior art devices and methods by providing a more efficient, cost effective method of making pockets in socks and fabricating a superior sock with a pocket which is more usable than prior art devices.

The method of the present invention may be used with "off-the-shelf" socks and the like, and comprises essentially the folding over of the cuff of the sock, "sealing" the fold by sewing the folded portion to create a compartment, and providing resealable means to enter said compartment via the use of "Velcro" (TM), buttons, zippers, snaps and the like.

As discussed supra, the present device and method is superior to that contemplated by the prior art, as it provides a compartmented area for the pocket without the necessity of a separate "pouch" member, thereby allowing fabrication utilizing less materials and labor, at a lesser cost.

It is therefore an object of the present invention to provide an improved sock with pocket and a related method, wherein the pocket is fabricated without the necessity of providing a separate pouch assembly.

It is a further object of the present invention to provide an improved pocket sock, wherein the pocket is configured in such a manner as to provide a compartment member with improved carrying means for carrying articles such as keys, change, and the like.

It another object of the present invention to provide an improved method of fabricating a pocket in a sock requiring less materials and labor than prior art methods.

It is still another object of the present invention to provide an improved pocket sock and method easily adaptable to a number of different closure means, including zippers, buttons, snaps and "Velcro" (TM), etc.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 7 is a side, perspective view of still another alternative embodiment of the present invention illustrating the utilization of ribbons tied as bows as the means of closure.

DETAILED DESCRIPTION of the PREFERRED, EXEMPLARY EMBODIMENTS

Figure 1:
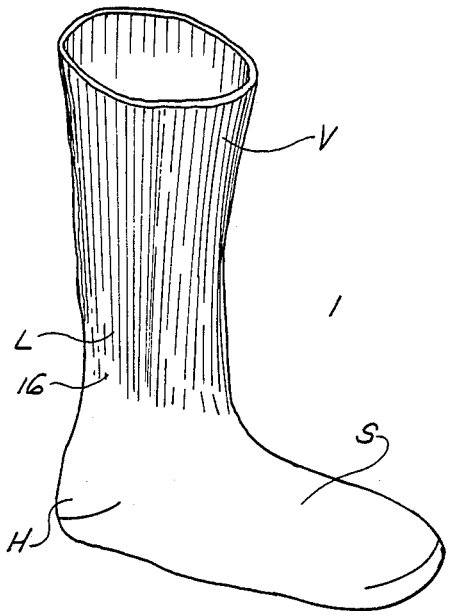
FIG. 1 is a side, perspective view of a typical sock, illustrating the configuration and differing knits as found in a typical sock.

As may be seen in FIG. 1, the sock S as preferably used with the present invention is of a thick, cushioned type, typically associated with sports socks and the like. Such a sock typically includes two primary types of knits—a smooth, cushioning knit enveloping the foot and heel areas and a courser knit having elastic properties for enveloping the upper area above the ankle and sometimes including the ankle.

Typically, the upper area of the socks made so by the inclusion of cotton knit or the like, configured for facilitating a desirable fit, in which the sock is prevented from "rolling" down the leg of the user, remaining secure in place even during athletic endeavors.

Referring to FIG. 1, the upper, lower leg enveloping portion 1 of the illustrated sock S forms that portion covering the ankle and calf area of the wearer.

Figure 2:
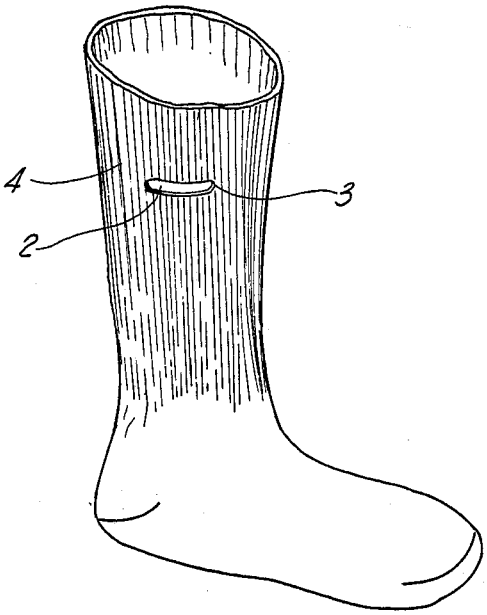
FIG. 2 is a side, perspective view of the preferred embodiment of the present invention illustrating the cut and placement of the horizontal opening of the present invention and in the first step in the method of fabricating the pocket sock of the present invention.
Figure 3:
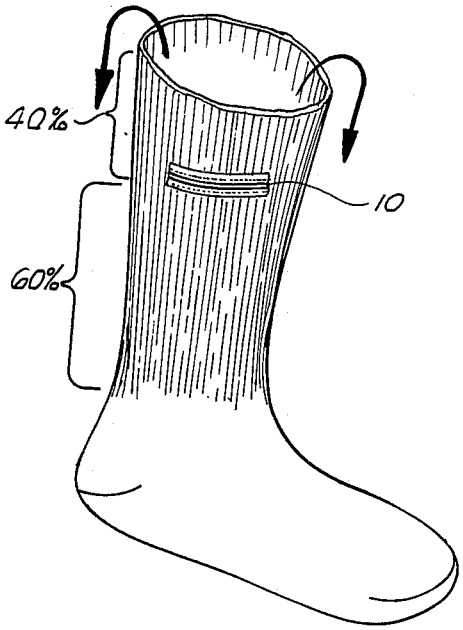
FIG. 3 is a side, perspective view of the preferred embodiment of the present invention illustrating the placement of the zipper and the folding over of a portion of the sock in creating a compartmented, pocket area.
Figure 4:
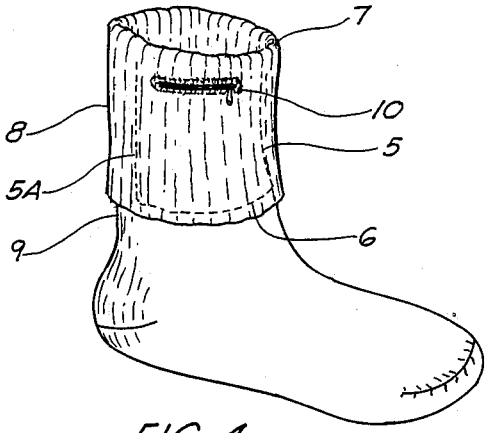
FIG. 4 is a side, perspective view of the preferred embodiment of the present invention illustrating the folding of the cuff and stitching in the fabrication of the pocket sock with the stitching being illustrated in phantom line.

In the principal embodiments illustrated in FIGS. 2–4, the opening in the pocket is of a horizontal type. This opening 2 is situated in FIG. 2 approximately sixty percent up the length of area 1 (60%) above the ankle area 16, or in the middle portion of area 1.

The opening 2 comprises a horizontal cut or slit through area 1 such that it allows communication between the outside and inside of the sock S of sufficient width for allowing passage of small articles such as keys, credit cards, small toys, or the like. To reinforce the opening to prevent undue wear and tear, the present invention contemplates the inclusion of weaving or stitching 3 around the periphery of the opening 2.

After fabricating the opening 2, the next step comprises the folding of upper calf portion or area 1 above the opening 2 such that the area U forms a wall juxtaposed over lower portion L, as illustrated in FIG. 4. Thus, upper area U thereby becomes outer wall 8, while lower area L becomes the inner wall 9. The folded periphery of the area 7 is preferably reinforced via threaded loops or the like. Of course, the upper portion may be folded so as to form an inner wall of a variety of different lengths, depending upon the contemplated usage of the pocket.

In forming the pocket, vertical stitching 5, 5A and horizontal stitching 6 are implemented. The stitching joins the inner 9 and outer 8 walls, thereby forming a compartmented area having an opening 2. The material used in stitching the pocket area may comprise, for example, cotton or elastic thread.

FIGS. 4–8 illustrate some of the many ways which might be used to provide closure means for the present invention.

FIG. 3,4 illustrates the implementation of a zipper arrangement 10 sewn into the periphery of opening 2. In the present embodiment, the zipper is provided such that the teeth are face down relative to the upper portion of opening 2.

In implementing the zipper means of closure, it has been found that fabrication is made easier and less laborious by incorporating the following method:

a. the sock S is turned inside out;

b. zipper 10 (or an alternate closure means) is sewn in the desired position between the upper U and lower L part of the sock;

c. the sock is zipped into the open position;

d. the portion of fabric blocking the zipper is cut so as to provide a means to access through sock S;

e. sock S is turned right side out;

f. the upper part U of sock is folded over the lower part, revealing the exterior of the zipper Z;

g. stitches 5, 5*a*, 6 are sewn, providing a compartmented pocket area; and h. braiding 7 may be added to the upper periphery of the sock for reinforcement.

Figure 5:
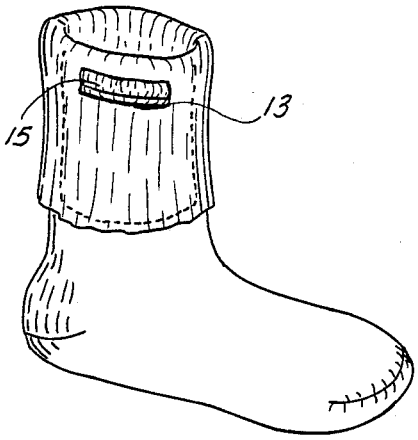
FIG. 5 is a side, perspective view of an alternative embodiment of the present invention illustrating the utilization of "Velcro" (TM) as the means of closure.

FIG. 5 shows the incorporation of "Velcro" (TM) means of closure with the present invention. In the present example, the hook portion 15 is affixed to the upper wall of opening 2, while the loop portion 13 is affixed to the lower wall, in such a manner so as to allow the hook and loop arrangements to communicate, providing means of closure. Lace or other accessories may be added along the opening to provide aesthetically appealing means of closure for, for example, women.

As is well known, "Velcro" is a type of fastener of the hook-and-loop type, which includes a base from which many loops extend working in conjunction with an opposed base which has many hooks extending from it. The hooks engage and hook into the loops, providing a temporary closure, which can be repeatedly opened and closed on demand.

Figure 6:
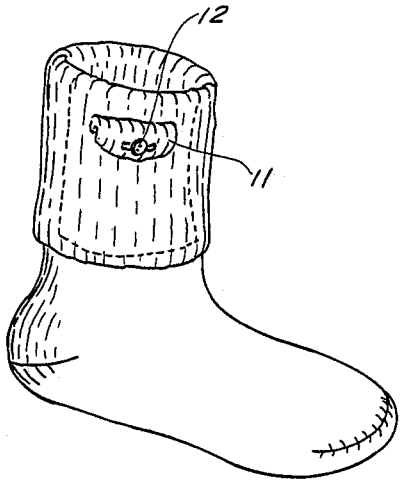
FIG. 6 is a side, perspective view of another alternative embodiment of the present invention illustrating the utilization of a button and flap configuration as the means of closure.
Figure 9:
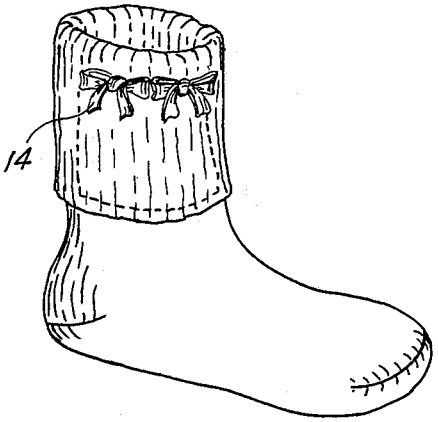
FIG. 9 is a side, perspective view of still another alternative embodiment of the present invention illustrating the vertically situated pocket arrangement without means of closure.

FIG. 6 illustrates the utilization of a button 12 and flap 11 arrangement. In the present example, the button 12 is affixed to the lower portion of opening 2, while flap 11 is sewn into the upper wall of same.

FIG. 7 illustrates a ribbon arrangement 4 which might be implemented to provide bows, providing a cosmetically appealing means of closure for, for example, young girls.

It is noted that a further alternative embodiment teaching similar means of closure and construction might be implemented with a vertically configured or disposed pocket, so as to allow for the carrying of elongated objects, such as pens and the like.

In providing a pocket for young children, the pocket may be more open to allow for easier access for small hands. This might be done by sewing the sock in vertical fashion similar to above. This may create a smaller pocket but still sufficient in size for containing keys, coins or the like, allowing ready access for little fingers.

It is further noted that the present method of manufacture is not restricted to off-the-shelf items and may be as easily implemented during the knitting process of the sock itself.

In this process, the slit would be provided in such a manner as to utilize the excess stitches conserved in forming the opening to provide reinforcement stitches around the periphery of opening 2, conserving thread and allowing an uninterrupted knitting cycle. In fact, the knitting machine might be programmed so as to automatically provide opening 2 and reinforcement 3, thereby substantially saving the costs of fabrication, as it would require no additional labor.

As related above, the natural weight of the fiber and means of construction permits carried objects to be held without distorting, tearing or abuse of the article. The elastic properties of the fabric comprising area 1 allows for consistent but gentle pressure, keeping the object in one position, but not pressing so hard so as to cause discomfort on the part of the wearer or distortion or crushing of the carried object. Further, the elastic and characteristics of knitted fabric allow for "give", thereby providing storage for a variety of sizes of articles.

It is noted that the present system may be designed for specialty applications, and may utilize fabrication methods other than the "elastic fabric" discussed above. For example, a stiffer fabric may be provided in fabricating a pocket for the carrying of keys, coins, or other small but potentially heavy items for use during high impact activities, such as jogging, contact sports, or the like.

It is noted that the terms "horizontal" and "vertical," as used above and in the claims, is being used in conjunction with and relative to the disposition of the sock S as shown in, for example, FIG. 1, namely as the sock is worn when the user is standing. Of course, such disposition would not generally exist at the time the pocket in the sock is being made, and the terms should be understood in the context of FIG. 1. Thus, "vertical" would mean substantially parallel to the direction of the length of the sock in the direction of the upper extension of the sock, i.e., from heel bottom to the top opening; while "horizontal" would mean substantially parallel to the direction of the foot extension portion of the sock, i.e., from heel to toe.

Figure 8:
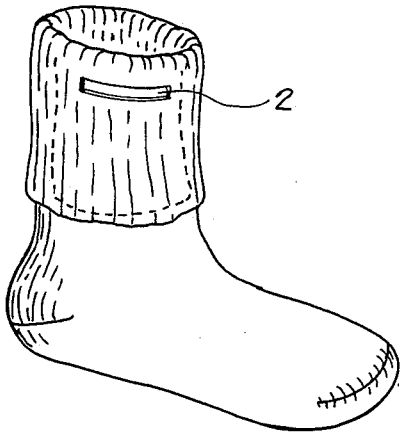
FIG. 8 is a side, perspective view of still another alternative embodiment of the present invention illustrating the horizontally situated pocket arrangement without means of closure.
Figure 9:
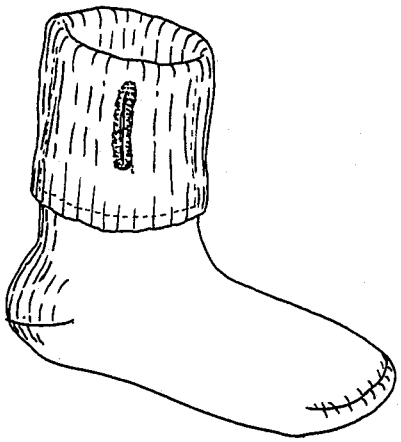

Referring to FIG. 8, exemplary dimensions are:

A) Length of opening- 2 inches

B) Width of pocket- 3 inches

C) Length of pocket- 4 inches

D) Size of sock- male size 9

The embodiments described herein in detail for exemplary purposes are of course subject to many different variations in structure, design, application and methodology. Because many varying and different embodiments may be made within the scope of the inventive concepts herein taught, and because many modifications may be made in the embodiments herein detailed in accordance with the descriptive requirements of the law, it is to be understood that the details herein are to be interpreted as illustrative and not in a limiting sense.

What is claimed is:

1. A method for fabricating a pocket having an inner wall and an outer wall in a sock or other item or hosiery having a calf area, comprising the following steps:

a. making an opening in the calf area of said hosiery item defining an upper and a lower calf portion, b. folding said upper calf portion and part of said lower calf portion including said opening, forming a fold above said opening such that said opening is juxtaposed to and is located below said fold, and an unfolded lower calf portion forms an inner wall behind said opening, and the folded portion of said calf area forms an outer wall, c. sewing said upper calf portion of said inner wall below said opening about said outer wall, and d. providing closure means for closing said opening, said closure means allowing said opening to be opened or closed on demand.

2. The method of claim 1, wherein there is included he additional said of:

stitching or knitting around the periphery of said opening to reinforce said opening.

3. The method of claim 1, wherein there is included the additional step of:

providing said fabric in the form of two knits a lower, cushioning knit enveloping the foot area and an upper knit having elastic properties enveloping the calf area.

4. The method of claim 3, wherein there is included the additional step of:

forming said upper knit via the inclusion of elastic thread.

5. The method of claim 3, wherein there is included the additional step of:

positioning said opening at approximately forty (40%) percent of the length of said upper knit from said socks opening.

6. The method of claim 1, wherein there is included the additional step of:

providing closure means selected from the group consisting of a snap arrangement, a zipper, VELCRO( TM ) closure, ribbon arrangement, or button arrangement.

7. The method of claim 1, wherein there is included the additional step of:

slitting the opening horizontally to a sufficient length to allow the entrance and removal of small articles such as credit cards, keys, change, and the like.

8. The method of claim 1, wherein there is included the additional step of:

slitting the opening vertically to a sufficient length to allow the entrance and removal of small articles such as credit cards, keys, change, and the like.

9. A method for fabricating a pocket in a sock or other item of hosiery, comprising the following steps:

a. providing a sock having inner and outer walls comprising a knitted tubular fabric closed at one end and designed for enveloping the foot to the lower leg of the use, b. arranging said sock such that its inner wall is exterior and its exterior wall is interior;

c. applying closure means to said fabric forming said inner wall;

d. making an opening in the fabric of the wall to which said closure means is applied, said opening configured so as to allow communication through said closure means when said closure means is in the open position;

e. arranging said sock such that its inner wall is interior and its exterior wall is exterior;

f. folding said upper calf portion and part of said lower calf portion including said opening, forming a fold above said opening such that said opening is juxtaposed to and is located below said fold, and an unfolded lower calf portion forms an inner wall behind said opening, and the folded portion of said calf area forms an outer wall g. sewing said inner wall to said outer wall, forming a compartmented area.

10. The method of claim 9, wherein there is included the additional step of:

stitching or knitting around the periphery of said opening to reinforce said opening.

11. The method of claim 9, wherein there is included the additional step of:

providing said fabric comprising two knits; a lower, cushioning knit enveloping the foot area and an upper, knit having elastic properties enveloping the calf area.

12. The method of claim 11, wherein there is included the additional step of:

forming said upper knit with elastic thread.

13. The method of claim 10, wherein there is included the additional step of:

positioning said opening approximately forty (40%) of the way down from the length of said upper area from the opening of said sock.

14. The method of claim 9, wherein there is included the additional step of:

slitting the opening horizontally to a sufficient length to allow the entrance and removal of small articles such as credit cards, keys, change, and the like.

15. The method of claim 9, wherein there is included the additional step of:

slitting the opening vertically to a sufficient length to allow the entrance and removal of small articles such as credit cards, keys, change, and the like.

16. A method for fabricating a pocket for pocket-size articles in an item of hosiery, such as, for example, a sock, comprising the following steps:

(a) folding over the top portion of the hosiery item to form an upper double wall portion in the item of hosiery;

(b) making a longitudinally extended, slit-like opening in the item of hosiery in the top portion of the hosiery, forming an opening through which pocket size articles can be inserted and removed; and (c) securing the two walls of the doubled wall portion of the folded over portion together about and extending away from the opening, forming an enclosed pocket-like chamber within the secured wall area, with the two walls of the secured double wall portion forming the walls of the chamber and the secured areas forming at least the major part of the periphery of the chamber and with the opening allowing access to the chamber for pocket-size articles.

17. The method of claim 16, wherein there is further included the step of:

(d) providing closure means in association with said opening for temporarily closing off said opening when desired, allowing said opening to be opened and then closed on demand.

18. The method of claim 17, wherein in step "d" there is included the step of:

(d-i) providing said closure means in the form of a closure having a fastener selected from the group consisting of zipper fasteners, hook-and-loop fasteners, ribbon fasteners, and button fasteners.

19. The method of claim 16, wherein there is included, in conjunction with step "b", the step of:

(b-i) making said opening in an area approximately forty (40%) percent of the way down the full length of said item of hosiery.

20. The method of claim 16, wherein there is included, in conjunction with step "b", the step of:

(b-i) making said opening in a "horizontal" direction.

21. The method of claim 16, wherein there is included, in conjunction with step "b", the step of:

(b-i) making said opening in an "vertical" direction.

22. The method of claim 16, wherein there is included after step "b" the step of:

(b-i) stitching or knitting around the periphery of said opening for reinforcing said opening.

23. A pocket in a sock or other item of hosiery comprising a knitted tubular fabric having inner and outer walls and closed at one end and designed for enveloping the foot and leg of the user, said pocket comprising:

an opening in the fabric of the wall to which a closure means is applied, said opening configured so as to allow communication through said closure means when said closure means is in the open position;

a fold in said fabric above said opening such that said inner wall is juxtaposed said opening; and means to sew said inner wall is a predetermined area to said outer wall, forming a compartmented area.

24. The pocket in a sock of claim 23, wherein the periphery of said opening is reinforced via stitching, or knitting.

25. The pocket in a sock of claim 24, wherein there said fabric comprising two knits; a lower, cushioning knit enveloping the foot area and an upper, knit having elastic properties enveloping the calf area.

26. The pocket in a sock of claim 25, wherein said upper knit is formed via the inclusion of elastic thread.

27. The pocket in a sock of claim 26, wherein said opening is positioned approximately forty (40%) of the way down from the length of said upper area from the opening of said sock.

28. The pocket in a sock of claim 27, wherein said closure means is selected from the group consisting of a zipper, snap arrangement, VELCRO(TM) closure, ribbon arrangement, or button arrangement.

29. The pocket in a sock of claim 28, wherein said opening is slit horizontally to a sufficient length to allow the entrance and removal of small articles such as credit cards, keys, and the like.

30. The pocket in a sock of claim 29, wherein said opening is slit vertically to a sufficient length to allow the entrance and removal of small articles such as credit cards, keys, change, and the like.

* * * * *